United States Patent [19]

Hulme

[11] 3,993,900

[45] Nov. 23, 1976

[54] SHUTTER FOR OPTICAL DETECTION

[75] Inventor: John Kenneth Hulme, Milan, Italy

[73] Assignee: Societa Italiana Elettronica S.p.A., Milan, Italy

[22] Filed: July 7, 1975

[21] Appl. No.: 593,447

[30] Foreign Application Priority Data

Aug. 2, 1974 Italy ..... 25906/74

[52] U.S. Cl. ..... 250/229; 250/233; 250/554

[51] Int. Cl.[2] ..... G01D 5/34

[58] Field of Search ..... 250/229, 233, 231, 554, 250/237

[56] References Cited

UNITED STATES PATENTS

| | | | |
|---|---|---|---|
| 1,929,400 | 10/1933 | Schulte | 250/231 R X |
| 2,100,934 | 11/1937 | Berges | 250/231 R X |
| 3,336,482 | 8/1967 | Mierendorf et al. | 250/229 |
| 3,906,222 | 9/1975 | Astier et al. | 250/229 |

*Primary Examiner*—David C. Nelms

[57] ABSTRACT

A shutter, for an optical detector head having a sleeve containing a focusing lens adjacent a first sleeve open end for directing incident radiation onto a photocell positioned at the other sleeve end, and includes a rotatable spherical shutter member of an optically opaque material and having a diametric aperture normally axially aligned between the photocell and the lens. A mask member having a central aperture of lesser diameter than the diameter of the shutter member is transversely positioned across the sleeve bore adjacent the surface of the shutter member nearest the lens, whereby incident radiation will be focused by the lens to pass through the aligned mask and shutter apertures to the photocell when the shutter aperture axis is aligned to be along the focal line of the lens. Low-friction bearing means formed through a portion of the sleeve wall rotatably engage a cylindrical pin having a first end joined to the surface of the shutter member perpendicular to the shutter aperture axis to achieve uniform rotational mass distribution; another end of the pin projects beyond the exterior of the sleeve and includes vane means engaged by bias means for rotatably positioning the shutter aperture axis in the normally aligned condition. Electrically controllable means cooperates with the vane means for applying a torque to the shutter member whereby the aperture axis is rotated away from alignment along the lens focal line thereby blocking the mask aperture and preventing incident radiation from impinging on the photocell.

11 Claims, 2 Drawing Figures

SHUTTER FOR OPTICAL DETECTION

BACKGROUND OF THE INVENTION

The present invention relates to optical detectors and more particularly to a novel shutter assembly for an optical detector head.

Known optical detector heads contain a sensitive detector element, such as a photocell and the like, for furnishing an electrical signal in the event a radiation of a predetermined wavelength, such as ultra-violet radiations emitted by a flame and the like, impinge thereon. The photocell is typically housed in an orientable container or detector head which serves to cool the photocell, to focus the incident radiation upon the photocell, and carefully aim the photocell at a particular zone of the radiation source, such as a flame, to be monitored. It is well known that the efficiency and selectivity of an optical detector increases as the photocell is brought closer to the source of radiation. In particular, when an optical flame detection head is used with a flame-producing burner of the aiming type, the detector head must be capable of proper angular movement to follow the aiming movement of the burner. In certain cases, detector heads extend directly into the interior of a boiler or furnace to place the photocell in close proximity to the flame.

Any photocell, especially one sensitive to ultra-violet radiation, is subject to breakdown whereby the photocell is unable to distinguish between the presence or the absence of the desired optical wavelength radiation. It is therefore advisable to frequently verify the operational efficiency of the photocell. Verification is normally accomplished by means of an optical shutter which interrupts the radiation path between the source to the photocell. During the obscuration period, the condition of disappearance of the signal furnished by the photocell is utilized to verify the integrity of the photocell.

The ambient conditions associated with the use of photocells inside a detector head subject to the above-described conditions results in frequent mechanical malfunctions. For an optical flame detector, the mean and maximum environmental temperatures are very high, the utilized materials tend to change as a result of the irradiation, and soot frequently infiltrates into the mechanism. The optical shutters previously employed in the art normally use levers, rods, gears and the like to obtain shutter movement and require a relatively large amount of preventive maintainance as the shutters are particularly subject to breakdowns. Because of these disadvantages, such shutter mechanisms are not compatible with the desired uninterrupted service of the installation as a whole unit. Additionally, the optical shutters known to the art generally do not insure total obscuration of the flame-emitted radiation due to the necessity to employ rather coarse mechanical tolerances as required to overcome the collateral effects of temperature and soot infiltration.

Such disadvantages become greater when the movable parts of the shutter have unbalanced movement masses. Many known shutters cannot be used in all positions as their movement is often counteracted by the weight of the movable parts themselves. This disadvantage requires that a greater motor force be used to overcome the larger resistance mechanical wear which increases the amount of friction between the parts until the shutter device soon becomes inefficient and unusable. Frequently, those devices previously known to the art could only function in certain positions.

BRIEF SUMMARY OF THE INVENTION

In accordance with the invention, a shutter for an optical detector assembly of the type having a sleeve, detector means positioned at a first sleeve end and responsive to incident optical wavelength radiation, and lens means positioned within the sleeve adjacent to a second open end thereof for focusing the incident radiation upon the radiation detector means, includes a rotatable spherical shutter member of optically opaque material having a diametric aperture therethrough; rotatable means coupled to the surface of the shutter member perpendicular to the aperture axis and passing through a portion of the sleeve wall for positioning the shutter member between the radiation detector means and the lens means with the aperture axis normally aligned along the focal line of the lens; an optically opaque mask member transversely positioned across the interior bore of the sleeve between the lens means and the shutter member and having an aperture of a lesser diameter than the diameter of the shutter member, the mask member being positioned adjacent the shutter member surface with the axis of both the mask and shutter apertures normally in alignment along the lens means focal line; vane means attached to another end of the rotatable support means adjacent an exterior surface of the sleeve; bias means coupled to the vane means for establishing the shutter member aperture axis normally along the lens means focal line; and electrically controlled means coupled to the vane means for rotating the shutter member aperture axis away from the lens means focal line, whereby the apertures of the shutter and mask members are no longer coincident and the incident radiation is prevented from impinging upon the radiation detector means.

It is therefore the primary object of the present invention to provide a shutter for an optical detector assembly capable of completely preventing all incident radiation from impinging on a radiation detector contained within the assembly.

Another object of the invention is to provide a shutter having completely balanced movable masses to minimize the magnitude of frictional and kinetic forces thereon and reduce the probability of breakdown.

It is a further object to provide a shutter possessing an extremely reliable design to permit the checking of the proper functioning of the radiation detector itself.

The above as well as other objects of the invention will become apparent from the following description of the accompanying drawings.

DETAILED DESCRIPTION OF THE INVENTION

Figure 2:
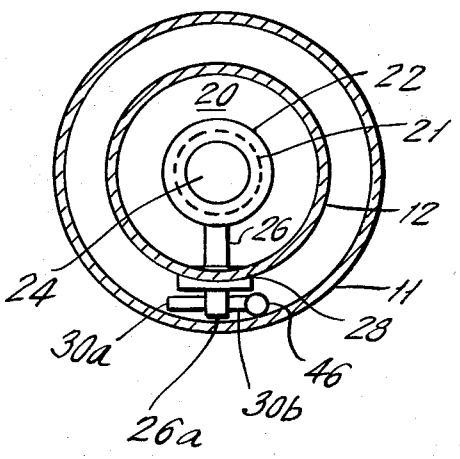
FIG. 2 is a sectional view in end elevation of the shutter and optical detector assembly taken along the line and in the direction of arrows 2—2 of FIG. 1.
Figure 1:
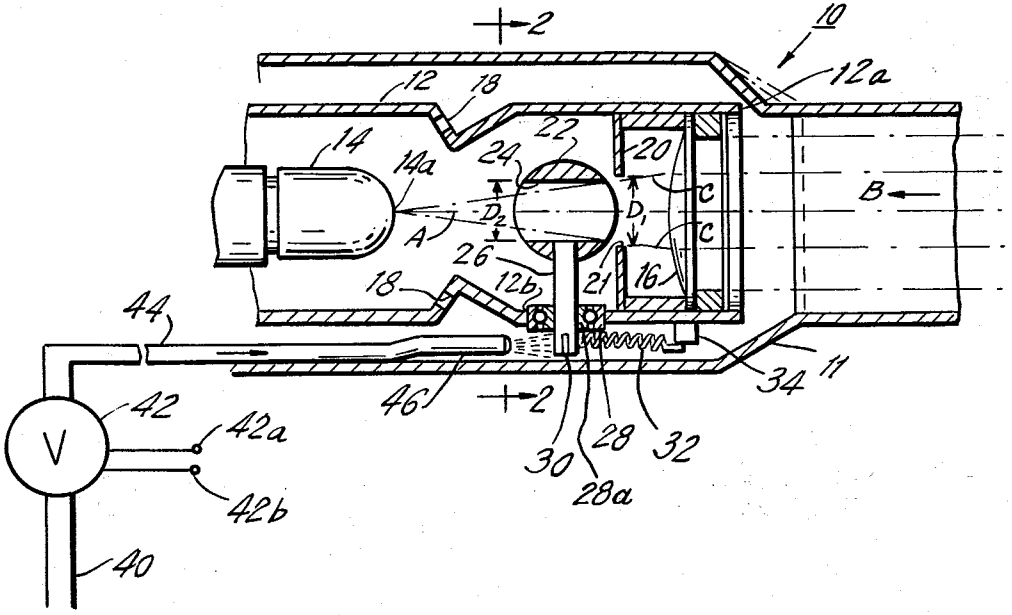
FIG. 1 is a sectional view in side elevation of a shutter in accordance with the invention and of a portion of an optical detector assembly in which the shutter is used.

Referring now to the figures, optical detection head 10 consists of an external sleeve 11 and an internal sleeve 12 fastened in axial alignment within the bore of external sleeve 11. A detector 14 sensitive to the desired radiation wavelength is positioned within the bore of internal sleeve 12 a predetermined distance inward from inner sleeve open end 12*a*. In a preferred embodiment, detector 14 is a photocell sensitive to ultra-violet radiation for use in optical detection of radiation emitted by a flame.

A lens structure 16, mounted transverse to the longitudinal axis of inner sleeve 12 and extending completely across the bore thereof, is inwardly positioned and adjacent to sleeve open end 12*a* at a distance from detector 14 approximately equal to the focal length of lens structure 16. The lens is preferably formed of a high-transparency material, such as quartz, for use in an optical flame detector exposed to relatively high ambient working environment temperatures. Advantageously, inner sleeve 12 contains a plurality of apertures 18 to allow a flow of compressed cooling air to pass therethrough for cooling detector 14.

A mask 20 of optically opaque material is transversely positioned across the bore of inner sleeve 12. Mask 20 has an aperture 21 of a first diameter $D_1$; the center of mask aperture 21 is positioned to lie along the focal line A of lens assembly 16. An optically opaque shutter member 22 of spherical shape has a diametric aperture 24 of diameter $D_2$. Mask aperture $D_1$ may be less than, equal to, or greater than shutter member aperture $D_2$, but must be less than the diameter of shutter member 22 to prevent radiation leakage around the shutter member.

A generally cylindrical pin 26 is mounted to the surface of shutter 22 with the axis of pin 26 perpendicular to the axis of aperture 24. An intermediate portion of pin 26 having collar 28is rotatably engaged by a low-friction bearings to annular collar 28 fastened in an aperture 12*b* formed through the wall of inner sleeve 12. The position of aperture 12*b* and the length of pin 26 are coordinated to position shutter member 22 adjacent to the surface of mask 20 nearest detector 14 with the axis of shutter member aperture 24 also aligned along lens focal line A when shutter member 22 is in the rest position, allowing passage of radiation emitted, for example, from a monitored flame (not shown) through the open end of outer sleeve 11 directed toward the flame and thence to travel in the direction of arrow B to enter inner sleeve open end 12*a*. The incident flame radiation is focused by lens assembly 16 into a cone of radiation generally directed at a point 14*a* on detector 14. The openings in mask aperture 21 and shutter member aperture 24 allows a cone of focused radiation, having an outer surface generally defined by rays C, to pass through mask 20 and thence through shutter member aperture 24, only when the shutter axis is aligned in the rest condition to lie along lens focal line A.

A simple vane 30 is attached to the free end 26*a* of pin 26 adjacent the outer surface of collar 28 and is positioned to be mutually transverse to the axes of cylindrical pin 26 and shutter member aperture 24. Thus, minimal torque is required to rotate shutter member 22 to change the direction of the axis of aperture 24 as the rotational mass distribution of shutter member 22, pin 26 and vane 30 is completely symmetric about the axis of pin 26, and the friction is minimized by use of the low-friction bearing assembly being support collar 28 and inner collar 28*a*.

Bias means 32, such as a helically-wound spring and the like, is attached at a first end to a radial extrusion 34 on the exterior surface of inner sleeve 12 and at a second end to a vane portion 30*a* radially extended from support pin 26. The distance between vane portion 30*a* and extrusion 34 is predeterminately selected whereby spring 32 applies a zero magnitude force to vane portion 30 *a* when shutter member aperture 24 is in the rest position and axially aligned along lens focal line A. Force is exerted by spring 32 on vane portion 30*a* only when an externally generated force tends to urge shutter member 22 from the rest position.

In a preferred embodiment, an externally generated force for moving shutter member 22 from the rest position is obtained by directing a stream of compressed air against another vane portion 30*b*. A source of compressed air (not shown) and a first pressure line 40 are connected through an electrically operable valve 42 to a second pressure line 44 terminated within optical detector head 10 at a nozzle end 46 positioned adjacent vane portion 30*b*.

In the normal operating condition, no actuating signal appears at the valve electrical terminals 42*a*, 42*b* and valve 42 prevents passage of compressed air into second pressure line 44 so that spring 32 maintains shutter member aperture 24 in the rest position with its axis aligned along lens focal line A as force is not exerted on vane portion 30*b*. The flame emitted radiation focused by lens assembly 16 passes through mask and shutter apertures 21, 24, respectively, to impinge upon photocell 14, which generates an electrical signal for use in flame monitoring apparatus (not shown).

In the test condition, a suitable electrical signal is applied to terminals 42*a*, 42*b* to actuate valve 42 to its open condition and allow a stream of compressed air to pass through second pressure line 44. The stream of compressed air emitted from nozzle portion 46 impinges upon vane portion 30*b* and generates sufficient torque to rotate shutter member 22 about the axis of pin 26 and sufficiently displace the axis of aperture 24 from lens focal line A for central mask aperture 21 to be completely blocked by the optically opaque material of shutter member 22. In this test condition, radiation is prevented from reaching photocell 14; the photocell generates an essentially zero magnitude electrical signal. The sudden cessation of the photocell electric output signal responsive to the actuation of valve 42 reliably assures proper operation of photocell 14.

Valve 42 closes upon cessation of the actuating signal applied to terminal 42*a* and 42*b*, the stream of air emitted by nozzle portion 46 is terminated and the energy stored in spring 32 serves to return shutter member 22 to its rest position, whereby flame-emitted radiation is again focused through mask and shutter apertures 21, 24, respectively, to impinge upon photocell 14.

There has just been described a novel shutter for use in an optical radiation detector and possessing completely symmetric and balanced rotational mass distribution, whereby minimal torque is required to rotate the shutter to prevent incident optical radiation from impinging on a radiation detector, thereby allowing the reliability of the detector to be checked in its normal environment while maintaining the normal efficiency of the radiation detector assembly at all other times.

The present invention has been described in connection with one preferred embodiment thereof. Many variations and modifications will now become apparent to those skilled in the art. It is preferred, therefore, that the present invention be limited not by the specific disclosure herein, but only by the appended claims.

What is claimed is:

1. A shutter mechanism for use in a detector assembly having stationary detector means for producing an output responsive to the presence of radiation emitted from a flame source, said shutter mechanism being positioned at spaced intervals between said source and said detector means and comprising:

a shutter member having a symmetric mass distribution about an axis of rotation and being formed of an opaque material, a central portion of said shutter member having a cylindrical shaped aperture formed therethrough with its longitudinal axis aligned transverse to said axis of rotation;

a stationary opaque mask member having an aperture and being positioned between said source and said shutter member;

said mask and shutter members lying along a path extending between said flame and said detector means;

bias means for normally maintaining said shutter aperture substantially in alignment with said path;

said mask and shutter member apertures, when aligned, cooperating to unblock the path between said radiation source and said detector;

selectively actuatable means for temporarily overcoming said bias means to rotate said shutter member about its axis of rotation towards a test position wherein said aperture is displaced from said path;

said rotated shutter member cooperating with said mask member to substantially prevent said radiation from reaching said detector means to periodically verify the proper operation of said detector means without disturbing the flame.

2. A shutter mechanism as set forth in claim 1, further including lens means positioned between said radiation source and one of said mask and shutter members furthest from said detection means, said lens means having an optical axis lying along said path for focusing said radiation from said source upon said detector means through said aligned mask and shutter member apertures.

3. A shutter mechanism as set forth in claim 1, further comprising means for rotatably supporting said shutter member regardless of the position to which said shutter member is rotated.

4. A shutter mechanism as set forth in claim 3, wherein said rotatable supporting means includes a substantially cylindrical member having an axis of revolution positioned to lie along said shutter member axis of revolution and having a first end joined to an exterior surface of said shutter member and a second end coupled to said bias means; and low-friction bearing means engaging an intermediate portion of said cylindrical member for supporting said shutter and cylindrical members during rotation thereof about their common axis of revolution.

5. A shutter mechanism as set forth in claim 4, wherein said low-friction means includes an annular collar surrounding said cylindrical member intermediate portion and low-friction bearing means partially enclosed within said annular collar for contacting an exterior surface of said cylindrical member intermediate portion.

6. A shutter mechanism as set forth in claim 4, wherein said rotatable supporting means further comprises a vane member extended transverse to the axis of rotation of said shutter member.

7. A shutter mechanism as set forth in claim 6, wherein said bias means is a spring member coupled to a first extended portion of said vane member and adapted to be at rest when said shutter aperture axis is aligned along said path.

8. A shutter mechanism as set forth in claim 7, wherein said selectively actuatable means includes a source of compressed air; conduit means coupled to said compressed air source for directing a stream of compressed air against said vane member; and normally-closed valve means coupled to said conduit means for temporarily enabling a flow of compressed air therethrough.

9. A shutter mechanism as set forth in claim 1, wherein said shutter member is a spherical shaped member having said cylindrical aperture therethrough.

10. A shutter mechanism for use in a flame detector assembly of the type having detector means for producing an output responsive to radiation emitted from a flame source and lens means for focusing said radiation upon said radiation detector means, said shutter mechanism comprising:

a spherical shutter member of an opaque material, said shutter member having an aperture formed therethrough the axis of said aperture being normally aligned with the optical axis of said lens means;

rotatable support means secured to said shutter member perpendicular to the axis of said aperture for positioning said shutter member between said lens and detector means with the axis of said aperture normally aligned along the optical axis of said lens means;

an opaque mask member having an aperture, said mask member being positioned adjacent to said shutter member with the axis of said mask aperture aligned with the optical axis of said lens means;

bias means coupled to said rotatable support means for normally maintaining said shutter member aperture substantially in alignment along said focal line;

said mask and shutter member apertures, when aligned, cooperating to allow passage of said radiation from said source and through said lens means to said detector means generally along said optical axis;

selectively actuatable means coupled to said rotatable supporting means and means operable upon said actuable means for temporarily overcoming said bias means to rotate such shutter member aperture toward a test position displaced from said optical axis;

said rotated shutter member cooperating with said mask member to substantially prevent said radiation from impinging upon said detector means to periodically verify the proper operation of said detector means without disturbing the source of the flame.

11. A shutter mechanism for use in a flame detector assembly of the type having detector means for producing an output responsive to radiation emitted from a flame source and lens means for focusing said radiation upon said detector means, said shutter mechanism comprising:

a shutter member of an opaque material, said shutter member having a balanced mass distribution about an axis of rotation to enable rotation of said shutter member about said axis of rotation with a selected minimum magnitude of torque applied thereto, a central portion of said shutter member having an aperture formed therethrough with its longitudinal axis aligned transverse to said axis of rotation;

rotatable support means attached to an exterior surface of said shutter member along said axis of rotation for positioning said shutter member between said lens and detector means with the axis of said aperture normally aligned along a focal line of said lens means;

an opaque mask member having an aperture, said mask member being positioned adjacent to the exterior of said shutter member with the axis of said mask aperture aligned with the optical axis of said lens means;

bias means coupled to said rotatable support means for normally maintaining said axis of said shutter member aperture essentially aligned along said focal line;

said mask and shutter member apertures, when aligned, cooperating to allow passage of said radiation from said source and through said lens means to said detector means generally along said optical axis;

selectively actuatable means for temporarily overcoming said bias means and for applying at least said minimum torque to cause said shutter member aperture axis to rotate to a test position displaced from said focal line;

said rotated shutter member cooperating with said mask member to substantially prevent said radiation from impinging upon said detector means to periodically verify the proper operation of said detector means without disturbing a source of the flame-emitted radiation.

* * * * *